United States Patent [19]

Chew, Jr. et al.

[11] 4,018,444

[45] Apr. 19, 1977

[54] RING WHIRLING DEVICE

[76] Inventors: Otto F. Chew, Jr., Hillside Drive; Louis W. Hinshaw, Box 111, both of Hays, Kans. 67601

[22] Filed: Sept. 25, 1975

[21] Appl. No.: 616,612

[52] U.S. Cl. ..... 273/109; 46/51; 273/DIG. 17; 273/DIG. 18; 273/DIG. 19

[51] Int. Cl.[2] ..... A63B 71/00

[58] Field of Search .... 273/109, DIG. 17, DIG. 18, 273/DIG. 19; 272/67; 46/47, 49, 51, 52

[56] References Cited

UNITED STATES PATENTS

| | | | |
|---|---|---|---|
| 2,068,053 | 1/1937 | Gehman | 46/70 |
| 2,814,157 | 11/1957 | Williams | 46/51 |
| 3,086,315 | 4/1963 | Fasano | 46/51 X |
| 3,306,612 | 2/1967 | Rosen | 46/51 X |
| 3,575,414 | 4/1971 | O'Brien | 46/51 |
| 3,659,849 | 5/1972 | Seymour | 46/52 |

OTHER PUBLICATIONS

Ring-Spinning Activity Toy Advertisement, Playthings, Apr. 1959, p. 125.

*Primary Examiner*—Anton O. Oechsle

[57] ABSTRACT

A skill toy for persons of all ages having a handle loosely supporting two spaced rings retained on hubs about which they are skillfully caused to rotate in opposite directions for amusement and exercise.

3 Claims, 5 Drawing Figures

FIG. 1
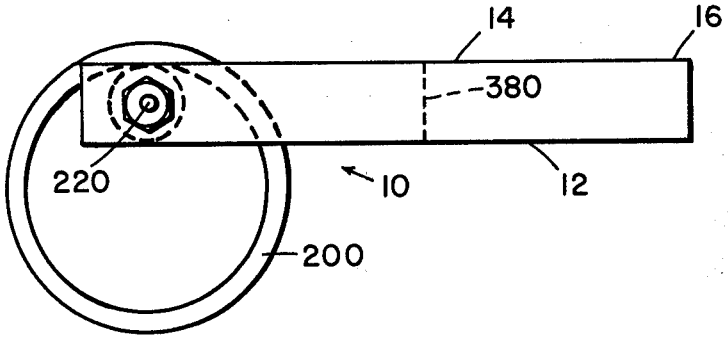
FIG. 2
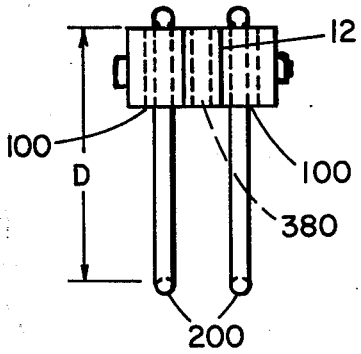
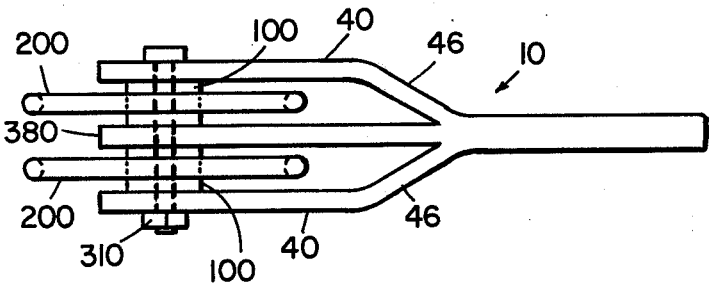
FIG. 3
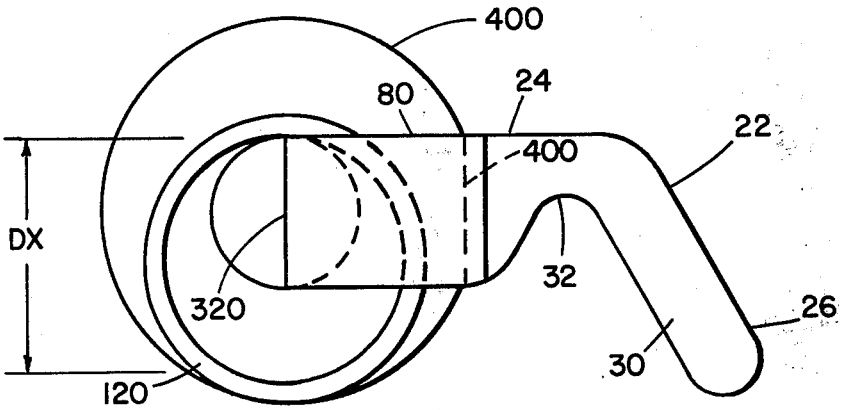
FIG. 4
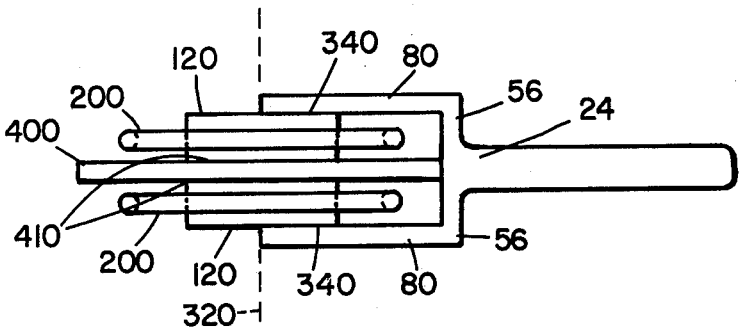
FIG. 5

RING WHIRLING DEVICE

FIELD OF THE INVENTION

This invention is in the field of exercise toys creating amusement because of the need for the use of skillful body movements to achieve a desired action.

DESCRIPTION OF THE PRIOR ART

In the prior art there has never been a skill toy having a plurality of rings which can be caused to counter-rotate by the exercise of a degree of skill and attention that is fun, relaxing and developing of coordination.

SUMMARY OF THE INVENTION

A toy calling for and developing physical and mental skills comprising a handle, hubs, and skirts, all of which define a frame, two rings disposed on the hubs and adapted to move thereabout, respectively, in clock-wise and counter-clock-wise directions as the toy is viewed from the side, said skirts being attached to the outer sides of said hubs and extending a sufficient distance beyond said hubs so as to prevent said rings from coming off the respective outer ends of said hubs, said hubs and said skirts together defining a hub and skirt means, and means attaching said hub and skirt means to said handle so that when said handle is caused to move in certain directions, said rings can be caused thereby to rotate or swing about said hubs generally in selective clock-wise and counter-clock-wise directions. It is a toy, thus defined, which is the main objective of this invention to provide.

A further object of this invention is to provide a toy as described which further has a separator mounted on its frame and disposed between its rings, and which extends outwardly from said hubs a sufficient distance for maintaining said rings in a spaced relationship on opposite sides of said separator.

Another objective is to provide a toy as described, which can be made, if desired, of flexible material such that it can fold in a minimum space.

A still further objective is to provide a toy as described which can be produced at a minimum cost and selectively with a plurality of handle styles including either a straight handle or a pistol grip type of handle.

BRIEF DESCRIPTION OF THE DRAWING

FIG. 1 is a side elevation of the skill toy of this invention with certain parts being shown in dotted lines.

FIG. 2 is a rear elevation of the toy of FIG. 1, as seen from the right hand side of FIG. 1, certain parts being shown in dotted lines.

FIG. 3 is a top plan view of the toy of FIG. 1 with parts shown in dotted lines.

FIG. 4 is a side elevation of a modification of the toy of FIG. 1.

FIG. 5 is a top plan view of the modified toy of FIG. 4.

DESCRIPTION OF THE PREFERRED EMBODIMENT

The toy of this invention is generally indicated at 10 in FIG. 1 and comprises a handle 12, having a forward end 14 and a rearward end 16. The handle 12 can extend generally straight forward from its rearward end to its forward end or, conversely, as shown in FIG. 4, the handle can be of modified form such as shown at

22, having a forward end 24 and a rearward end 26, in which latter case the rearward end 26 is much lower than the forward end 24 so that a rearward section or handle 30 is provided extending downwardly and rearwardly from the forward end 24, preferably with the notch 32 on the underside.

Forwardly from the forward end 14 of the handle of FIG. 1, or from the forward end 24 of the handle 22 of FIG. 4, there extends a pair of spaced apart retaining skirts 40 which are horizontally spaced apart and which are connected to the forward ends 14 or 24 of the respective handle modification by rearwardly and inwardly extending portions 46 in the modification of FIGS. 1 and 3, and by inwardly extending portions 56 in the case of the modifications of FIGS. 4 and 5.

Disposed between the forwardly extending skirts 40 of the modification of FIGS. 1 and 3, or 80 of the modification of FIGS. 4 and 5, are a pair of hubs 100, which can be relatively smaller, as seen in FIGS. 1 and 3, or somewhat larger as seen in the modification hubs 120 of FIGS. 4 and 5.

On each hub 100 or 120 there is disposed a ring 200, which very loosely fits the hub 100 or 120, respectively, and as best seen in FIG. 2, the fit can be so loose that an interior diameter of one of the rings 200 can be shown at D in FIG. 2 to be almost three times the diameter of the cylindrical hubs 100.

Conversely, as in FIGS. 4 and 5, the looseness of fit can be such that the diameter DX in that modification of the respective rings 120 can be the same as in the FIGS. 1 and 2 modification, but can be even slightly less than half of the total diameter of a cylindrical hub 120, it being understood that a hub 120 has the axis of its cylindrical configuration normally extending horizontally, such axis being seen in FIGS. 1 and 2 at 220, and in FIGS. 4 and 5 at 320.

The hub 100 can be secured to the skirts 40 by means of a bolt 310, as shown in FIG. 3, or simply by means of glue 340 at adjoining surfaces, as seen in FIG. 5. Between the skirts 40 there is disposed a separator 380 in FIGS. 2 and 3, or 400 in the modification of FIG. 5 and the separator, for beauty, can be circular, as shown in FIGS. 4 and 5, or it need not be, as shown in FIGS. 2 and 3.

The separator 400 is preferably fixed to the hubs 120, as seen in FIG. 5, and the separator 380 is fixed to the hubs 100 in FIG. 3. However, the separators 380 and 400 extend over to the forward end of the respective handles 12 and 22 and are attached thereto for strength and also to illustrate the fact that they are preferably large enough as separators to extend completely from the respective axis 220 or 320 and far enough out from the respective axis to extend beyond the path of movement of outermost parts of the respective rings 200.

In the modification of FIG. 5 glue can be used at 410 to secure the hubs 120 to the separator 400.

In operation an operator or player whose turn it is to operate the new toy, grips the handle and holds the toy extended forwardly or even to the person's side.

By jiggling or otherwise agitating the toy, the operator attempts to cause the two rings to rotate in opposite directions with respect to one another which requires a degree of skill. The length of time the operator can maintain the rings in this counter-rotation is a further indication of skill.

Some operators will learn to lay the toy on its side so that its hub axis is vertical and still keeps the rings moving in counter-rotation.

Some can go through the sequence of maintaining the counter-rotation while pointing the toy straight up, on its side, or even behind their back. Some will acquire the skill of being able to change the toy from one hand to the other while maintaining the counter-rotation spin. Some can change hands under a lifted leg; some can change hands behind their back. Still others will be able to maintain the counter-rotation spinning while the toy is handed to another person or even exchange for a similar toy held by the other person.

Many people can pass one or more of the toys around without losing the continuity of the rotation. A rule can be made that anyone who loses the continuity of the spin of the ring while passing a toy to another person must drop out of the game so that the last person left is the winner.

Some can learn to hold two toys, one in each hand, and keep them going. Others can learn to attach them to their feet or to their hat, head, elbow or to their knee and effectively maintain the spinning.

Still others can attach the toy to their belt and cause it to spin with an interesting body motion.

The total size of the device can vary so much that it could be made small enough to fit into a person's conventionally size pocket, such as a suit pocket. The toy can be made of either stiff material or flexible material. For example, it can be made of a material such as soft rubber or soft thermo-plastic material of such great flexibility that the toy can be folded to carry it in one's pocket entirely with no part sticking out of a conventionally sized pants pocket of a person for example.

Another degree of skill is exhibited by so wobbling the toy that the pattern of spin established will cause the rings to rotate at different speeds relative to each other, whereby with both rings moving in the same direction, one will seem to be chasing the other, an especially difficult maneuver.

It will be seen that the toy can be used for exercise, recreation or competition and it will develop skills leading to better coordination and also useful in physical therapy and muscle building.

It can be especially valuable as a recreational toy for persons very greatly in need of the pleasures of play, such as persons suffering from hypertensions due to the fears and anxieties involved in mental illness. Conversely, it is valuable as a device for helping to maintain good mental health and whimsical and amused viewpoints, and relaxed nerves.

In a word, the new toy can be "fun".

We claim:

1. A toy requiring skill in its operation comprising a frame, said frame having a handle having a forward end, at least two hubs on said frame, a plurality of rings disposed one on each of said hubs and each ring loosely receiving its respective hub therethrough whereby said rings can define motions about their respective hubs as will appear to be generally clockwise and counter-clockwise selectively as said rings are each viewed from a side thereof, said frame having skirt means thereon disposed in positions for preventing said rings from moving sidewise of themselves excessively toward respective sides of said frame for restraining said rings from coming off of said frame by movements sidewise of said rings and toward the outer side of said frame, and in which said frame has a separator thereon which is disposed between said rings and is of a size for causing all parts of said rings to be spaced apart with respect to each other at all times.

2. The toy of claim 1 in which said separator is circular in outline as seen in side elevation surrounding the majority of its exterior.

3. A toy requiring skill in its operation comprising a frame, said frame having a handle having a forward end, at least two hubs on said frame, a plurality of rings disposed one on each of said hubs and each ring loosely receiving its respective hub therethrough whereby said rings can define motions about their respective hubs as will appear to be generally clockwise and counter-clockwise selectively as said rings are each viewed from a side thereof, said frame having skirt means thereon disposed in positions for preventing said rings from moving sidewise of themselves excessively toward respective sides of said frame for restraining said rings from coming off of said frame by movements sidewise of said rings and toward the outer side of said frame, and in which said hubs are each substantially of cylindrical shape on their exterior, and the cylindrical configurations of the exterior of said hubs being disposed in alignment for defining a hub axis, said handle extending substantially directly rearwardly from said axis.

* * * * *